United States Patent [19]

Hoffman

[11] Patent Number: 4,835,367

[45] Date of Patent: May 30, 1989

[54] PORTABLE ELECTRIC RADIANT FAN HEATER UTILIZING CERAMIC PANEL SHIELDED HALOGEN LAMP

[75] Inventor: Erich Hoffman, Bergisch Gladbach, Fed. Rep. of Germany

[73] Assignee: Robert Krups Stiftung & Co. KG., Solingen, Fed. Rep. of Germany

[21] Appl. No.: 50,612

[22] Filed: May 15, 1987

[51] Int. Cl.[4] ..... H05B 3/00; F24C 7/04; F24H 3/02

[52] U.S. Cl. ..... 219/377; 219/343; 219/347; 219/354; 219/368; 219/370

[58] Field of Search ..... 219/377, 366–368, 219/370, 354, 343, 347, 346, 351

[56] References Cited

U.S. PATENT DOCUMENTS

| | | | |
|---|---|---|---|
| 1,006,767 | 10/1911 | Mauger | 219/377 X |
| 1,524,075 | 1/1925 | Yokel | 219/377 |
| 2,051,456 | 8/1936 | Muir et al. | 219/377 |
| 2,131,484 | 9/1938 | Ringwald | 219/377 |
| 3,077,531 | 2/1963 | Wompey | 219/377 |
| 3,360,765 | 12/1967 | Strange et al. | 219/354 X |
| 3,486,004 | 12/1969 | Morrone | 219/347 X |
| 3,663,798 | 5/1972 | Speidel et al. | 219/354 X |
| 3,792,230 | 2/1974 | Ray | 219/377 X |
| 4,178,500 | 12/1979 | Brindkopke | 219/351 X |
| 4,263,500 | 4/1981 | Springer et al. | 219/377 |
| 4,350,871 | 9/1982 | Davis et al. | 219/377 X |
| 4,626,659 | 12/1986 | Charmes et al. | 219/343 |

FOREIGN PATENT DOCUMENTS

| | | | |
|---|---|---|---|
| 2950001 | 6/1981 | Fed. Rep. of Germany | 219/377 |
| 142128 | 8/1983 | Japan | 219/347 |

*Primary Examiner*—Anthony Bartis
*Attorney, Agent, or Firm*—Peter K. Kontler

[57] ABSTRACT

A portable fan heater wherein the housing has a front opening in register with a ceramic panel which transmits infrared radiation. The panel is located in front of one or more halogen lamps, such as quartz lamps, whose radiation is directed toward the panel by a reflector having a concave side facing the lamp or lamps and having its center of curvature in or close to the panel. One lamp (or the single lamp) is located at the focal point of the reflector. The housing contains a rotary fan which is driven by an electric motor and serves to convey currents of air from several inlets in the rear wall of the housing toward and into the opening. The currents flow through constricted channels which are defined by the outer side of the reflector and the adjacent inwardly convexly curved walls of the housing.

8 Claims, 3 Drawing Sheets

PORTABLE ELECTRIC RADIANT FAN HEATER UTILIZING CERAMIC PANEL SHIELDED HALOGEN LAMP

BACKGROUND OF THE INVENTION

The invention relates to heaters in general, and more particularly to improvements in electric heaters, especially portable fan heaters (also called heater blowers).

A portable fan heater has a housing for a heating unit and a rotary impeller which draws air into and conveys air through the housing and past the heating unit to discharge heated air by way of one or more openings or to merely circulate air in the area around the heater. The heating action can be regulated by changing the number of active heating elements and/or by changing the intensity of heat which is emitted by the active heating element or elements. As a rule, the heating elements are electric resistance heaters which are often mounted on a star-shaped array of insulating plates. Each resistance heater comprises a normally convoluted wire which is heated in response to connection with a source of electrical energy. The means for regulating the intensity of heating action includes suitable switches or other regulating elements which enable the user to elect one of two or any one of more than two (normally three) different heating actions. The rotary impeller is mounted in the housing and is driven by an electric motor to circulate air which distributes the generated heat in one or more desired directions.

A drawback of conventional heaters which employ heating elements in the form of resistance heaters is that the cost of such heating elements is high and their installation in the housing of the heater is a complex and time-consuming operation. Thus, it is necessary to coil the wire in order to form individual heating elements, and such elements must be mounted on the aforementioned insulating plates which normally surround a hub and jointly constitute a star-shaped or like carrier of resistance heaters. Another drawback of conventional heaters is that the resistance heaters require a relatively long interval of time to emit heat at the desired maximum rate, and that the interval of cooling of such resistance heaters is also long. Therefore, substantial quantities of heat and electrical energy are lost subsequent to completion of the circuit of one or more resistance heaters as well as upon disconnection of the resistance heater or heaters from the energy source. Heat energy which is supplied by the resistance heaters upon disconnection from the energy source is wasted.

OBJECTS AND SUMMARY OF THE INVENTION

An object of the invention is to provide an electric heater, particularly a portable fan heater, which is constructed and assembled in such a way that the amount of wasted heat energy when the heater is put to use and when its heating element or elements are disconnected from the energy source is a fraction of the energy which is wasted in conventional heaters.

Another object of the invention is to provide novel and improved means for heating air in the above outlined heater.

A further object of the invention is to provide novel and improved heating means for use in the above outlined heater.

An additional object of the invention is to provide an electric heater which is simpler and less expensive but more reliable and more economical than conventional heaters.

Still another object of the invention is to provide a heater which is more efficient than heretofore known heaters that consume the same amount of electrical energy, and to provide the heater with novel and improved means for directing air in the desired direction or directions.

A further object of the invention is to provide a novel and improved method of heating air with a portable fan heater.

Another object of the invention is to provide an electric fan heater which can emit heat at a maximum rate in practically immediate response to completion of the circuit of its electric heating element or elements and which ceases to emit heat practically instantaneously in response to disconnection of its heating element or elements from the energy source.

The improved electric heater can constitute a portable fan heater and comprises a housing having at least one heat-discharging opening, and heating means provided in the housing and including a halogen lamp (such as a quartz lamp) and reflector means for directing toward the opening heat which is emitted by the halogen lamp. The heater preferably further comprises a panel which registers with the opening and transmits infrared radiation. The reflector means can include a portion having a concave side which faces the lamp to reflect radiation upon the panel. The center of curvature of the concave side of the aforementioned portion of the reflector means is located in or can be located close to the pane. Such panel can be made of a ceramic material. The lamp is preferably mounted in the focal point of the reflector means.

The two end portions of the lamp (if the lamp is an elongated lamp) can be mounted in sockets which are provided therefor in or on two spaced-apart walls of the housing. Substantially plate-like holder means can be interposed between at least one of the sockets and the respective wall of the housing.

The reflector means and the housing preferably define at least one air-conveying channel having a discharge end in communication with the opening of the housing to promote the flow of air into the opening and the heating of such air by radiation which passes through the panel. The arrangement may be such that the preferably convex outer side or surface of the reflector means confronts one or more convex surfaces on the wall or walls of the housing, and such surfaces of the reflector means and the wall or walls of the housing flank the aforementioned channel or channels.

The heating means can comprise a plurality of halogen lamps and the reflector means can include at least one reflector for each halogen lamp or a reflector for sets (e.g., pairs) of neighboring lamps. Such heater is preferably further provided with means for connecting selected lamps with a suitable source of electrical energy to thereby regulate the intensity of the heating action.

The housing can be provided with one or more inlets for air and can contain a rotary fan and a motor which drives the fan to draw air through the inlet or inlets and to convey the drawn-in air toward and into the opening.

The novel features which are considered as characteristic of the invention are set forth in particular in the appended claims. The improved heater itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
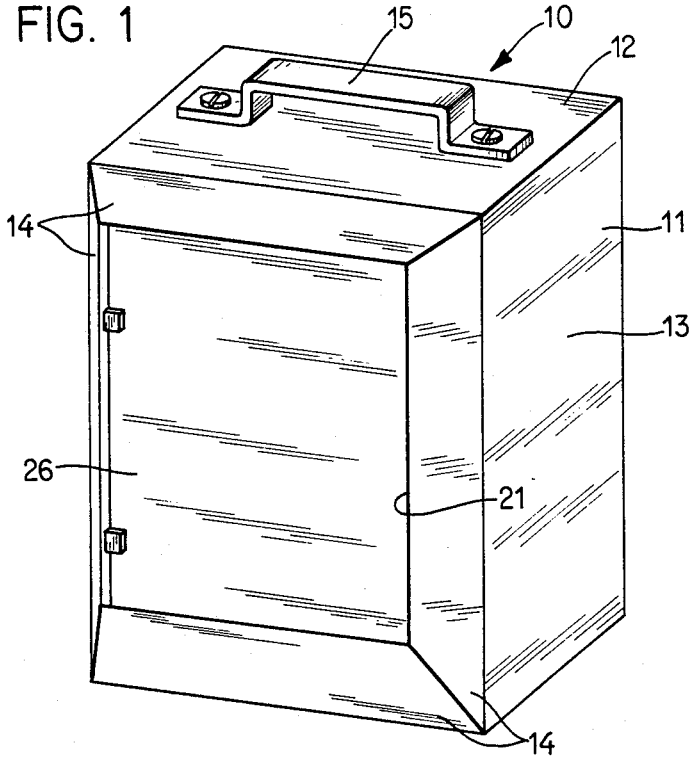
FIG. 1 is a schematic perspective view of a portable fan heater which embodies one form of the invention.
Figure 2:
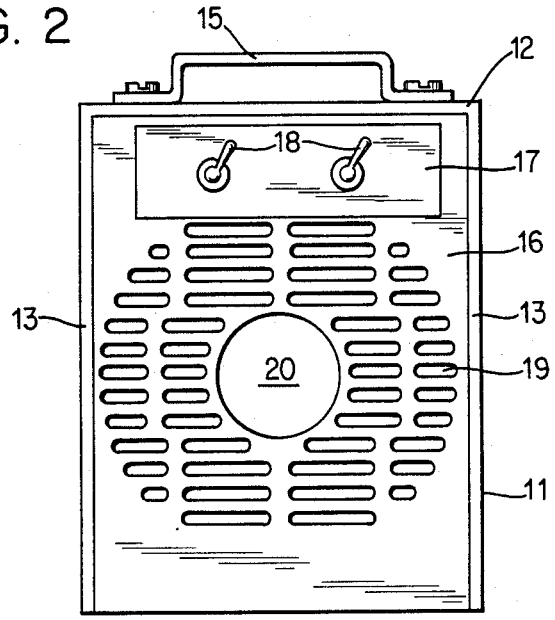
FIG. 2 is a rear elevational view of the heater.
Figure 3:
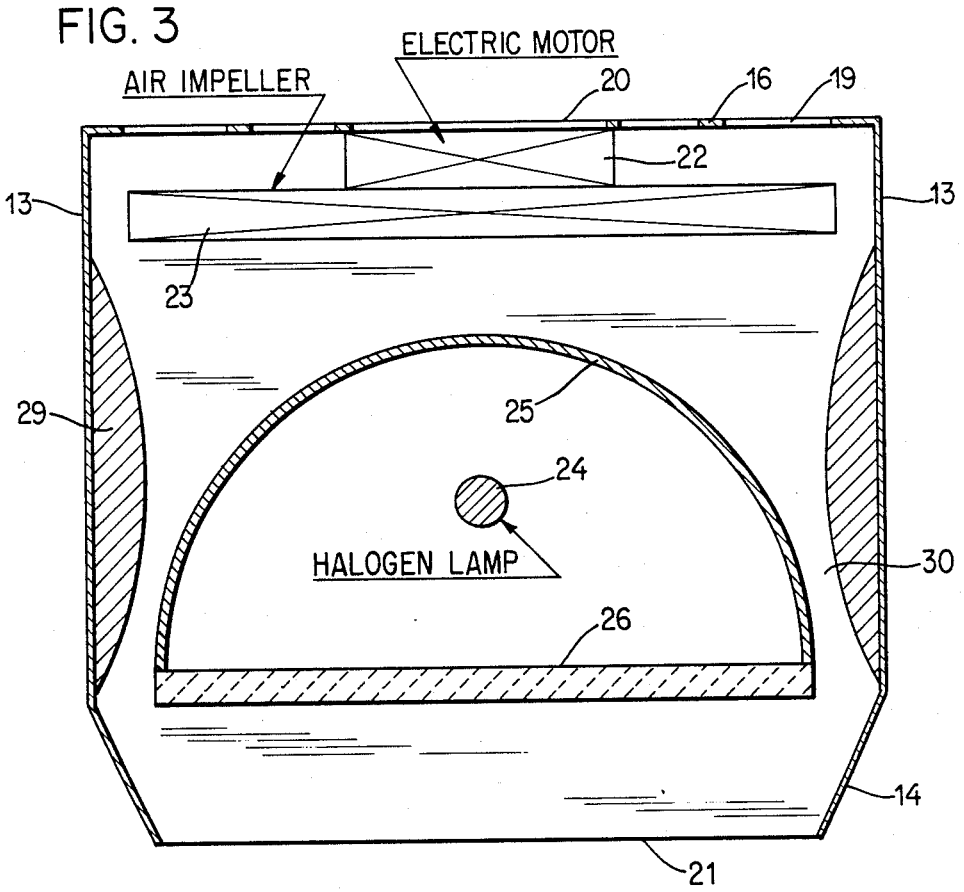
FIG. 3 is an enlarged schematic horizontal sectional view of the heater.
Figure 4:
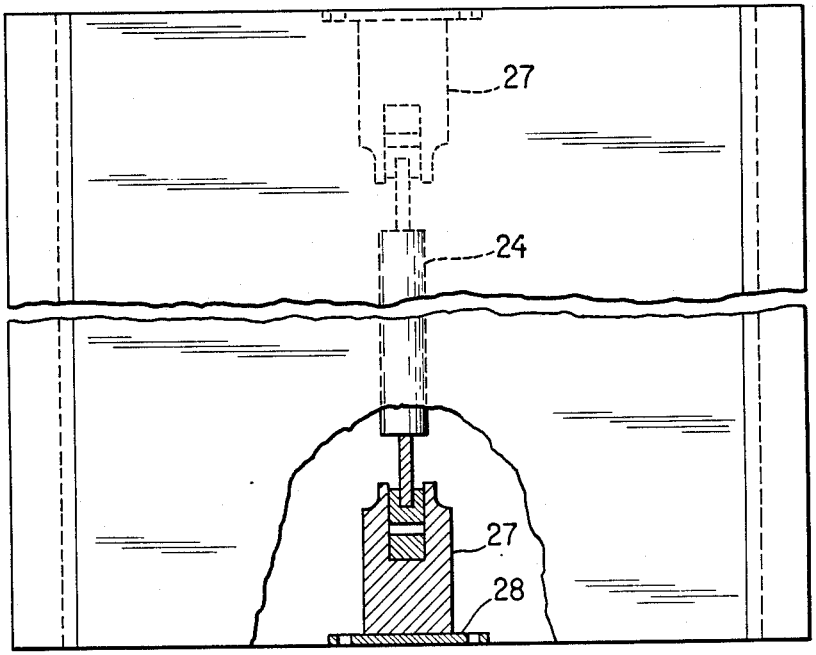
FIG. 4 is a fragmentary elevational view of the heating element in the housing of the heater.

Referring first to FIGS. 1 to 4, there is shown a portable fan heater or heater blower 10 which includes a block-shaped housing 11 with a top wall 12 carrying a handle 15 to facilitate transport to a selected locale of use. Certain conventional parts of the heater 10 have been omitted for the sake of clarity; such parts include the elements (such as a cable and plugs) which serve to connect the electric heating element 24 with a source of electrical energy and means for regulating the heating action of the element 24. The end portions of the handle 15 are affixed to the top wall 12 by screws or other suitable fasteners. The substantially rectangular sidewalls 13 of the housing 11 flank a frame-like front wall 14 which surrounds a heat discharging opening 21.

The rear wall 16 of the housing 11 has a plurality of inlets 19 in the form of horizontal slits serving to admit atmospheric air which is conveyed through the housing 11 and is evacuated by way of the opening 21 in the front wall 14. The rear wall 16 further carries a box 17 which switches 18 or analogous control or regulating elements for the electrical components of the heater. The actuators for the switches 18 are accessible at the exposed side of the box 17 to intensify or weaken the heating action, to connect or disconnect the heating element 24 from the energy source and/or to start or arrest an electric motor 22 which is disposed in front of a centrally located circular aperture 20 in the rear wall 16 and serves to drive a rotary impeller or fan 23 of the air circulating means. The exact construction of the motor 22 and impeller 23 form no part of the invention. The impeller 23 can be mounted directly on the output element of the motor 22 or it can be driven by the motor through the medium of a suitable transmission, not shown.

In accordance with a feature of the invention, the heating element 11 and in front of a panel 26 which registers with the opening 21 includes an elongated halogen lamp with a tubular envelope whose end portions are mounted in sockets 27 provided therefor in or on the top wall 12 and in or on the bottom wall of the housing 11. The lamp 24 and the sockets 27 therefor are available on the market, the same as the motor 22 and impeller 23. It is preferred to mount the sockets 27 on substantially plate-like holders 28 which are affixed to the inner sides of the respective (top and bottom) walls of the housing 11. The sockets 27 can be screwed, bolted, riveted or otherwise separably or permanently secured to the respective holders 28 which, in turn, can be bonded, bolted, riveted or otherwise affixed to the inner sides of the respective walls.

The means for heating air in and in front of the housing 11 further comprises a reflector 25 which resembles or constitutes a substantially semicylindrical metallic shell and is mounted in the housing 11 between the top wall 12 and the bottom wall, i.e., in front of the rear wall 16. The marginal portions of the reflector 25 can be affixed to the aforementioned panel 26 which is preferably made of a ceramic material, such as a vitreous enamel known as Ceran (trademark), adapted to store heat and to transmit infrared radiation. The center of curvature of the reflector 25 is preferably located in or close to the panel 26, and the lamp 24 is or can be mounted at the focal point of the reflector. Radiation which issues from the lamp 24 passes directly through the panel 26 or impinges upon and is deflected toward the panel by the concave inner side of the reflector 25.

The controls of the improved heater 10 in the box 17 are or can be designed in such a way that the motor 22 is started only for a relatively short interval of time upon completion of the circuit of the lamp 24 via socket or sockets 27 i.e., when the air in the area to be heated is cool. When the air in such area has been heated to a selected temperature, the motor 22 for the impeller 23 is turned off, either manually or by a suitable thermostat. When the motor 22 is on, the impeller 23 draws air through the sliti-shaped inlets 19 and through the central aperture 20 of the rear wall 16 and compels such air to flow through channels 30 which are defined by the convex rear or outer side of the reflector 25 and by the adjacent convex surfaces on portions 29 of the sidewalls 13 of the housing 11. The inner side of the frame-like front wall 14 tapers toward and directs into the opening 21 air streams which issue from the channels 30 and which are heated by radiation passing through the panel 26. A certain amount of heating takes place during contact of air streams with the convex side of the metallic reflector 25. The impeller 23 can draw air into a single channel or into more than two channels (e.g., into a total of four channels including the channels 30 at the inner sides of the sidewalls 13, a third channel beneath the top wall 12 and a fourth channel above the bottom wall of the housing 11). The surfaces which bound the channels 30 and/or additional channels for the flow of air from the inlets 19 and aperture 20 toward the opening 21 can be configured in many other ways without departing from the spirit of the invention.

Extensive experiments were carried out with a heater whose housing was 180 mm wide, 170 mm deep and 250 mm high. The panel 26 was made of Ceran and had a width of 210 mm, a thickness of 8 mm and a height of 210 mm. The output of the lamp 24 was 750 watts, the panel 26 was heated to a temperature of 250° C., and the temperature of air in front of the heater was approximately 70° C. Air was circulated at the rate of 98.5 $m^3$ per hour, and the velocity of conveyed air was 0.76 m/sec.

Figure 5:
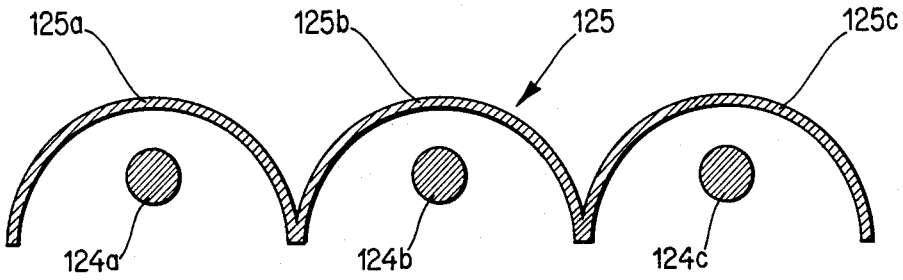
FIG. 5 is a schematic horizontal sectional view of a modified heater with three heating elements.

FIG. 5 shows a portion of a modified fan heater with a plurality of halogen lamps 124*a*, 124*b*, 124*c* each in front of the concave side of a portion (125*a*, 125*b*, 125*c*) of a modified reflector 125. The number of lamps can be reduced to two or raised to four or more, and the number of lamps per portion of the reflector can be two or more. The lamps need not be vertical and the heater can employ U-shaped halogen lamps each of which is mounted in a single socket. A single semicylindrical reflector can be placed behind and partly around two or more halogen lamps.

It is clear that the controls of a heater which employs two or more halogen lamps can be designed to connect individual lamps or more than a single lamp in circuit with a suitable source of electrical energy, such as a conventional wall outlet. The manner of connecting two or more conventional heating elements to an energy source, so that each element can be activated individually or jointly with one or more additional heating elements, is well known in the art and need not be described here.

It is further clear that the housing of the improved heater can have two or more air- and heat discharging openings which can be provided in the front wall, in the top wall, in one or both sidewalls or in two or more different walls of the housing. The channels in the housing are then designed to convey air to each of the openings as soon as the motor for the impeller is started. Of course, the provision of a housing with two or more air- and heat-discharging openings can render it necessary or advisable to use two or more halogen lamps as well as to distribute the lamps in a manner to ensure adequate heating of air issuing from each of the openings. Alternatively, the output of a single lamp can be selected with a view to ensure adequate hearing of air streams which are discharged by way of two or more openings. The reflector or reflectors need not surround the respective lamp or lamps in their entirety, as long as they ensure the transmission of adequate amounts of heat by way of the respective panel or panels.

An important advantage of the improved heater is that it need not employ electric resistance heaters. The halogen lamp or lamps can be caused to emit radiation at a maximum rate practically instantaneously in response to completion of their circuit or circuits, and such lamp or lamps cease to emit radiation as soon as they are disconnected from the energy source. This entails substantial savings in heat as well as in electrical energy.

The reflector or reflectors of the improved heater serve primarily to reflect radiation toward the respective panel or panels. An additional function of the reflector or reflectors is to shield the housing from overheating and/or to effect a certain preheating of air which is conveyed toward the opening or openings of the housing. Adequate shielding of the housing from heat renders it possible to make the housing from materials, including numerous plastic substances, which cannot stand elevated temperatures. Experiments with the improved heater indicate that the housing is heated very little or not at all, even if it is in use for extended periods of time.

As mentioned above, the material of the panel or panels 26 is selected with a view to ensure that the panel or panels can store substantial amounts of heat as well as that each panel will intercept small amounts of infrared radiation, i.e., the major part of such radiation penetrates into and heats air in the surrounding area. In addition, the panel or panels store heat and radiate such heat into the area which is to be heated. Each panel acts not unlike a diffusor, i.e., it does not transmit heat only in a selected direction.

An additional advantage of the improved heater is that the halogen lamp or lamps constitute one or more sources of light in the heated area.

If the user of the heater wishes to rapidly heat the area in which the heater is used, and if the air in such area is relatively cold, the motor 22 is started to drive the impeller 23 which circulates a relatively large quantity of air by drawing air through the inlets in the rear wall of the housing and by causing such air to leave the housing by way of one or more openings. The circulating air effects a rapid distribution of heat in the area to be heated. The motor 22 is thereupon turned off, either by hand or automatically while the lamp or lamps continue to emit heat. The provision of specifically designed channels for the flow of air toward and into the opening or openings of the housing is desirable but optional. Such air is subjected to at least some heating action by infrared radiation or by radiated heat even before it reaches the corresponding opening or openings of the housing. The means for regulating the operation of the motor 22 (e.g., a thermostat or the like) can be set up in such a way that the motor is started again and again at desired intervals whenever the temperature in the room or area which is being heated drops to or below a preselected value. Automatic on-off regulation of the motor 22 is preferred at this time because this ensures that the heater maintains the temperature of air in the heated area at or close to a desired value and also because the motor is not driven unnecessarily. Moreover, the area in which the heater is put to use is less likely to be overheated because the motor is shut off as soon as the temperature rises to a preselected value.

It has been found that the improved heater generates little noise. In fact, the operation is practically noiseless when the motor 22 is off. It was also found that the heating action is normally sufficient even if the impeller 23 is off, i.e., forced circulation of air by means other than the circulation attributable to heat which is emitted by the lamp or lamps is desirable or necessary only when the heater is placed into a cold area or if it is desired to avoid pronounced fluctuations of the temperature of air in such area. Absence of forced circulation of air is preferred by many users because this eliminates draft in the heated area. The heating action of an appliance which cause little circulation of air, at least during the major part of the interval of heating, is much more pleasant to the occupant or occupants. All in all, the components including the motor 22 and the impeller 23 can be said to constitute desirable and advantageous but optional features of the improved heater.

An advantage of placing the lamp 24 at the focal point of the reflector 25 and of having the center of curvature of the concave side of the reflector in or close to the panel 26 is that a large percentage of infrared radiation which issues from the lamp 24 passes directly into and through the panel to reach the area which is to be heated. The substantially semicylindrical concave surface of the reflector 25 reflects the remaining infrared radiation to impinge upon the panel 26 substantially at right angles to the plane of the panel. Such radiation also penetrates through the panel (which is or can be flat) practically without losses to reach the area adjacent the front side of the housing 11 and to heat the air therein.

While it is equally within the purview of the invention to employ specially designed lamps and sockets for use in the improved heater, it is presently preferred (particularly for utilization in mass-produced moderately priced heaters) to employ commercially available quartz lamps or analogous heating elements and commercially available sockets therefor. This contributes significantly to lower cost of the entire heater. Halogen lamps with a desired output and in a wide variety of sizes and shapes are available on the market. The housing of the improved heater can employ two or more lamps of different sizes and/or shapes if this is desirable or necessary for greater compactness and greater efficiency of the appliance.

Halogen lamps which can be used in the portable fan heater of the present invention are manufactured and distributed by Radium Lampenwerke Wipperfurth, German Federal Republic, under Catalog No. 12 1223 oo317.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A portable space heater, comprising a housing having at least one heat discharging opening; heating means provided in said housing and including a halogen lamp and reflector means for directing toward said opening heat which is emitted by said lamp, said reflector means having an outer side and said housing including wall means having at least one convex surface defining with the outer side of said reflector means at least one air-conveying channel having a discharge end at said opening, an intake end and a flow constricting intermediate portion which narrows in a direction from said intake end and widens in a direction toward said discharge end; a panel which contains ceramic material and transmits infrared light, said panel being installed in said housing in register with said opening; and means for drawing air into said housing and for discharging the drawn-in air by way of said opening.

2. The heater of claim 1, wherein said reflector means includes a portion having a concave side facing said lamp to reflect radiation upon said panel, said concave side having a center of curvature at least close to said panel.

3. The heater of claim 1, wherein said reflector means has a focal point and said lamp is located at the focal point of said reflector means.

4. The heater of claim 1, wherein said housing includes two spaced-apart walls and said lamp has end portions adjacent said spaced apart walls, and further comprising sockets provided on said spaced apart walls for the respective end portions of said lamp.

5. The heater of claim 4, further comprising a substantially plate-like holder interposed between at least one of said sockets and the respective wall.

6. The heater of claim 1, wherein said heating means includes a plurality of lamps and said reflector means has at least one portion for reflecting radiation from each of said lamps.

7. The heater of claim 6, further comprising means for connecting selected lamps of said heating means with a source of electrical energy.

8. The heater of claim 1, wherein said housing has at least one inlet and said means for drawing air includes a rotary fan installed in said housing and means for driving said fan.

* * * * *